US009768482B2

(12) United States Patent
Lorenzo et al.

(10) Patent No.: US 9,768,482 B2
(45) Date of Patent: Sep. 19, 2017

(54) COMPACT RADIOFREQUENCY EXCITATION MODULE WITH INTEGRATED KINEMATICS AND COMPACT BIAXIAL ANTENNA COMPRISING AT LEAST ONE SUCH COMPACT MODULE

(71) Applicant: THALES, Courbevoie (FR)

(72) Inventors: Jérôme Lorenzo, La Salvetat Saint Gilles (FR); Pierre Bosshard, Tournefeuille (FR); Jérôme Brossier, Fonsorbes (FR); Benjamin Monteillet, Toulouse (FR); Abdelkader Meziani, Saubens (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 14/949,548

(22) Filed: Nov. 23, 2015

(65) Prior Publication Data

US 2016/0149280 A1 May 26, 2016

(30) Foreign Application Priority Data

Nov. 26, 2014 (FR) ..... 14 02674

(51) Int. Cl.

| | |
|---|---|
| ***H01Q 3/08*** | (2006.01) |
| ***H01P 1/06*** | (2006.01) |
| ***H01P 1/161*** | (2006.01) |
| ***H01Q 13/02*** | (2006.01) |
| ***H01Q 15/24*** | (2006.01) |
| ***H01Q 3/20*** | (2006.01) |
| *H01Q 19/19* | (2006.01) |

(52) U.S. Cl.

CPC ..... *H01P 1/062* (2013.01); *H01P 1/067* (2013.01); *H01P 1/161* (2013.01); *H01Q 3/08* (2013.01); *H01Q 3/20* (2013.01); *H01Q 13/02* (2013.01); *H01Q 15/242* (2013.01); *H01Q 13/0241* (2013.01); *H01Q 19/192* (2013.01)

(58) Field of Classification Search

CPC ..... H01Q 3/08; H01Q 3/20; H01Q 13/02
USPC ..... 343/756
See application file for complete search history.

(56) References Cited

U.S. PATENT DOCUMENTS

| | | | | |
|---|---|---|---|---|
| 3,715,688 | A * | 2/1973 | Woodward | H01P 1/067 333/1 |
| 2007/0013457 | A1* | 1/2007 | Tavassoli Hozouri | H01P 1/067 333/21 R |
| 2010/0149058 | A1 | 6/2010 | Bosshard et al. | |

(Continued)

FOREIGN PATENT DOCUMENTS

WO 2013/150994 A1 10/2013

*Primary Examiner* — Dameon E Levi
*Assistant Examiner* — Andrea Lindgren Baltzell
(74) *Attorney, Agent, or Firm* — Baker & Hostetler LLP

(57) ABSTRACT

The compact excitation module comprises two radiofrequency RF exciters and a rotary joint coupled together along a common longitudinal axis, the rotary joint comprising two distinct parts, respectively fixed and rotating around the common longitudinal axis, the two radiofrequency exciters being mounted one on each side of the rotary joint, respectively on the fixed and rotating parts, and axially coupled together by the rotary joint. The compact excitation module further comprises a rotary actuator provided with an axial transverse opening, the rotary joint being housed in the axial transverse opening of the rotary actuator.

9 Claims, 10 Drawing Sheets

(56) References Cited

U.S. PATENT DOCUMENTS

| | | | | |
|---|---|---|---|---|
| 2012/0154239 | A1* | 6/2012 | Bar-Sade ..... | H01Q 1/1242<br>343/839 |
| 2014/0104125 | A1 | 4/2014 | Choiniere et al. | |
| 2015/0054703 | A1 | 2/2015 | Yano et al. | |

* cited by examiner

COMPACT RADIOFREQUENCY EXCITATION MODULE WITH INTEGRATED KINEMATICS AND COMPACT BIAXIAL ANTENNA COMPRISING AT LEAST ONE SUCH COMPACT MODULE

CROSS-REFERENCE TO RELATED APPLICATION

This application claims priority to foreign French patent application No. FR 1402674, filed on Nov. 26, 2014, the disclosure of which is incorporated by reference in its entirety.

FIELD OF THE INVENTION

The present invention relates to a compact radiofrequency excitation module with integrated kinematics and a compact biaxial antenna comprising such a compact module. It applies to antennas with pointing agility that must offer a wide pointing field in terms of azimuth and elevation, as well as emitting, receiving and/or bipolarizing functions. It applies in particular in the space sector, to satellite-mounted antennas.

BACKGROUND

Satellites in low orbit, termed non-synchronous, have only limited volume available for the installation of antenna equipment. When the mission demands both high pointing agility and emitting, receiving and bipolarizing functions of the antenna, the volume allocated in terms of height for the installation of the antenna is often critical.

The known solutions for antennas with pointing agility do not simultaneously allow for pointing kinematics along with a bipolarizing function and an emitting and receiving function within a constrained volume.

Notably known is the design of a reflector antenna comprising a centred fixed source, in which the reflector possesses rotational symmetry and comprises a pointing mechanism that rotatively actuates it along two axes, i.e. azimuth and elevation. Pointing agility is obtained by virtue of the reflector's movement. However, the rotational symmetry of the reflector does not allow the gain of the antenna to be maximized at the limit of the coverage, nor control of the cross-polarization performance over a wide scanning field. Additionally, it is difficult to minimize the height of the antenna due to the position of the source, which is generally a significant distance away from the reflector and the length of the waveguide for reaching the source is considerable. Furthermore, this antenna solution does not allow operation at high angles of elevation.

Also known is the design of an antenna with dual reflectors comprising a source positioned in front of the secondary reflector, in which pointing agility of the antenna is obtained on an azimuthal axis by virtue of the movement of the assembly of the two reflectors and the source. The pointing agility of the antenna on an elevation axis is obtained by virtue of the movement of the assembly of the two reflectors with respect to the source, which remains fixed. The disadvantages are that this antenna solution does not allow a bipolarizing function and furthermore, the volume required for the installation of the antenna kinematics is considerable.

Also known is the design of an antenna comprising a centred reflector, in which pointing agility is obtained by an assembly of three linear actuators associated with articulated arms. The bipolarization radiofrequency junction is ensured by two coaxial cables. The disadvantages are that this solution presents considerable bulk, mass and cost. Furthermore, the radiofrequency links made by means of flexible coaxial cables present problems regarding lifespan.

SUMMARY OF THE INVENTION

The aim of the invention is to overcome the disadvantages of the known antennas with pointing agility and to design a compact radiofrequency excitation module with integrated kinematics capable of being connected to a radiating element of an antenna, assuring the pointing agility of the antenna in terms of azimuth and elevation and allowing operation in one or more frequency bands and for a single or two different polarizations.

To this end, the invention relates to a compact excitation module comprising two radiofrequency exciters and a rotary joint coupled together along a common longitudinal axis, the rotary joint comprising two distinct parts, respectively fixed and rotating around the common longitudinal axis, the two radiofrequency exciters being respectively mounted on the fixed and rotating parts of the rotary joint and axially coupled together by means of the rotary joint. The compact excitation module furthermore comprises a rotary actuator provided with an axial transverse opening oriented along the common longitudinal axis, the rotary joint being housed in the axial transverse opening of the rotary actuator.

Advantageously, the fixed and rotating parts of the rotary joint are fitted together, without contact, parallel to the common longitudinal axis, the two fixed and rotating parts each comprising a transverse cylindrical axial opening forming an axial cylindrical waveguide.

Advantageously, the fixed and rotating parts of the rotary joint are separated by an intermediate space and, in the intermediate space, at least one of the fixed or rotating parts can comprise walls equipped with corrugations.

Alternatively, in the intermediate space, at least one of the fixed or rotating parts can comprise walls equipped with at least one cavity.

Advantageously, each radiofrequency exciter comprises a main waveguide mounted along the common longitudinal axis and coupled to the axial cylindrical waveguide of the rotary joint.

Advantageously, each RF exciter can comprise an orthomode transducer OMT coupled to the main waveguide of the RF exciter.

Alternatively, each RF exciter can comprise a polarizer coupled to the main waveguide of the RF exciter.

The invention also relates to a compact biaxial antenna comprising two compact excitation modules and a radiating horn associated with a polarizer, the longitudinal axes of the two compact modules being oriented so as to be perpendicular to one another, the second compact module being linked to the polarizer to which the radiating horn is connected.

The invention finally relates to a compact biaxial antenna comprising a single compact excitation module, a radiating horn associated with a polarizer, a reflector and a plane mirror placed around the radiating horn and inclined with respect to an axis of elevation, the radiating horn being positioned in front of the reflector, the compact excitation module comprising a longitudinal axis oriented along an azimuthal axis.

BRIEF DESCRIPTION OF THE DRAWINGS

Other features and advantages of the invention will appear clearly in the following description, given by way of purely illustrative and non-limitative example, with reference to the appended schematic drawings which show.

DETAILED DESCRIPTION

Figure 1:
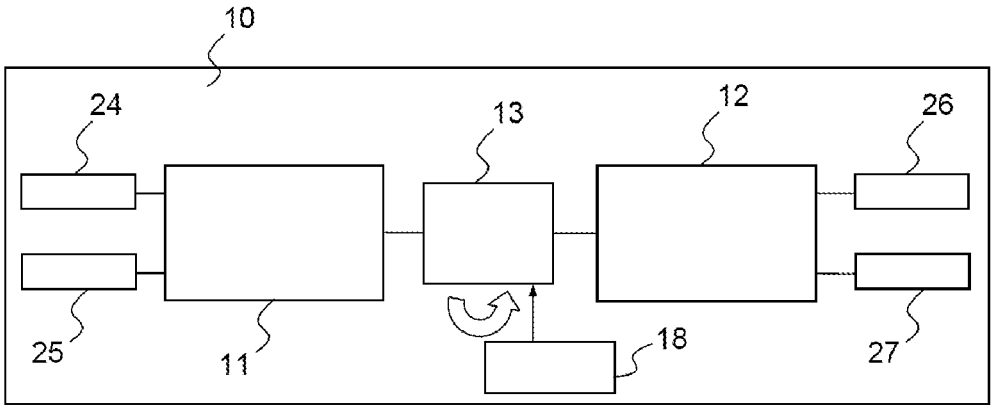
FIG. 1: a block diagram of a compact excitation module with integrated kinematics, according to the invention.
Figure 2:
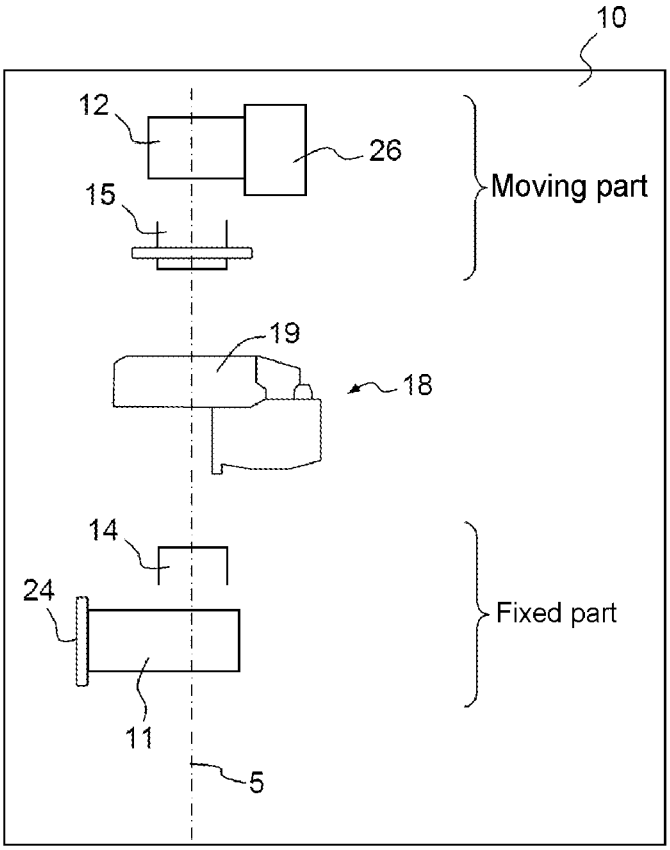
FIG. 2: an exploded-view diagram of the axial arrangement of the compact excitation module with integrated kinematics, according to the invention.
Figure 3A:
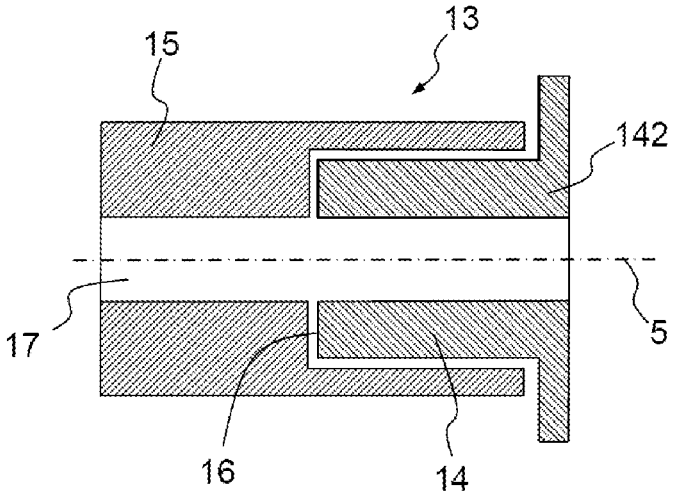
FIG. 3*a*: an axial sectional diagram of a first embodiment of the rotary joint, according to the invention.
Figure 3B:
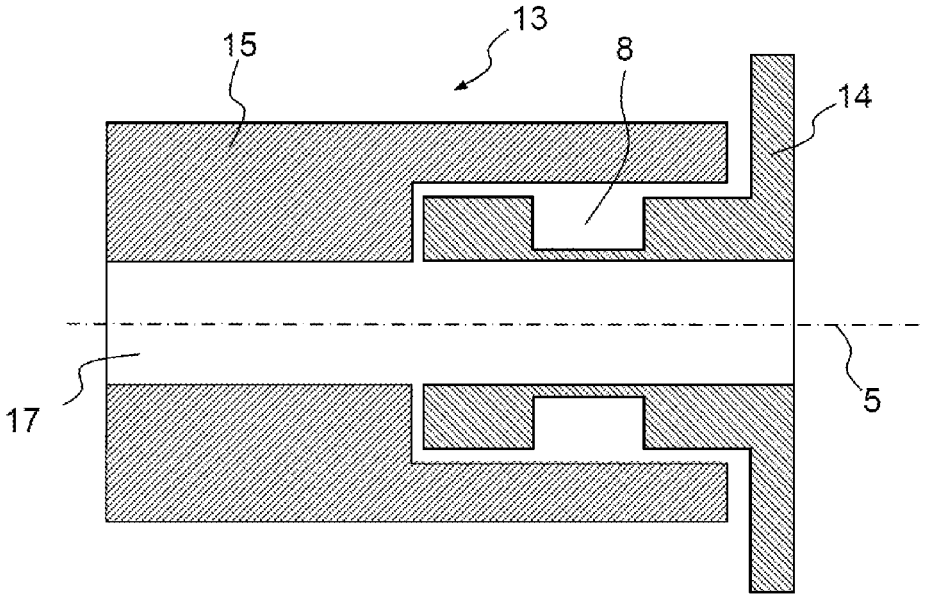
FIG. 3*b*: an axial sectional diagram of a second embodiment of the rotary joint, according to the invention.

According to the invention, the compact excitation module 10 shown in FIGS. 1 and 2 comprises two radiofrequency RF exciters 11, 12 coupled together parallel to a longitudinal axis 5 by means of a rotary joint 13 coupled to a rotary actuator 18. As shown in FIGS. 3*a* and 3*b*, the rotary joint is composed of two distinct parts 14, 15, respectively fixed 14 and rotating 15, fitted together, without contact, parallel to the longitudinal axis 5, the two fixed and rotating parts comprising a transverse cylindrical axial opening forming an axial cylindrical waveguide 17 common to both the fixed and rotating parts 14, 15. The two parts, respectively fixed 14 and rotating 15, of the rotary joint 13 respectively form a stator and a rotor rotating around the longitudinal axis 5. The two RF exciters 11, 12 are mounted one on each side of the rotary joint 13, respectively on the fixed 14 and rotating 15 parts of the rotary joint. The first RF exciter 11 mounted on the stator of the rotary joint is therefore fixed, whereas the second RF exciter 12 mounted on the rotor of the rotary joint rotates around the longitudinal axis 5. The compact excitation module shown in FIG. 1 furthermore comprises at least one input port linked to a corresponding port of the first RF exciter 11 and at least one output port linked to a corresponding port of the second RF exciter 12. The number of input and output ports of the compact excitation module 10 is equal to the number of channels of each RF exciter. For example, this number is equal to 1 when each RF exciter used is single channel and equal to two when each RF exciter is dual channel, as shown in the example in FIG. 1 which comprises two input ports 24, 25 and two output ports 26, 27. It is also possible to use RF exciters comprising a number of inputs/outputs greater than two.

In the example shown in FIG. 3*a*, the geometries of the two parts, respectively fixed 14 and moving 15, of the rotary joint are of complementary forms, male and female, and are separated by an intermediate space 16. In the example explicitly shown, the rotor 15 is the female part and the stator 14 is the male part, although alternatively the inverse configuration is also possible, in which the rotor would be the male part and the stator the female part. Within the intermediate space 16 separating the two male and female parts of the rotary joint 13, the walls of the male and female parts may be flat and smooth as illustrated in FIG. 3*a*. Alternatively, within the intermediate space 16, the walls of the male and/or female parts can comprise corrugations which constitute radiofrequency traps, each radiofrequency trap being equivalent to an electrical short circuit, thus allowing electromagnetic leakages to be avoided between the two parts of the rotary joint. Alternatively, within the intermediate space 16, the radiofrequency trap can consist of a cavity 8 built into the wall of the male part 14 and/or of the female part 15 of the rotary joint 13, as shown in FIG. 3*b* for example, or of multiple successive cavities. The transverse cylindrical axial opening 17 of the rotary joint 13 forms a waveguide with a circular cross section allowing, for example, the propagation of two electromagnetic waves with crossed circular polarization between the two RF exciters 11, 12.

Each RF exciter comprises a main waveguide mounted along the common longitudinal axis 5 and coupled to the axial cylindrical waveguide 17 of the rotary joint 13. The architecture of the RF exciters 11, 12 is of no consequence from a functional point of view. The only requirement is that the exciters are made using waveguide technology and that they are capable of producing one or more RF waves, whether in the fundamental electromagnetic mode TE11 with circular polarization, or in an electromagnetic mode with rotational symmetry, such as the TM01 mode for example. It is thus possible to use known RF exciters comprising a single RF channel and a single operating frequency band, or exciters comprising two RF channels operating in bipolarization and within a single frequency band. Similarly and in a known manner, for operation in two or more different operating frequencies, it is possible to use an RF exciter with two or more stages, each stage being dedicated to a particular frequency, or to combine the RF exciter with a polarizer. In the case of operation in bipolarization, each RF exciter can comprise a septum polarizer or an orthomode transducer OMT.

Figure 4:
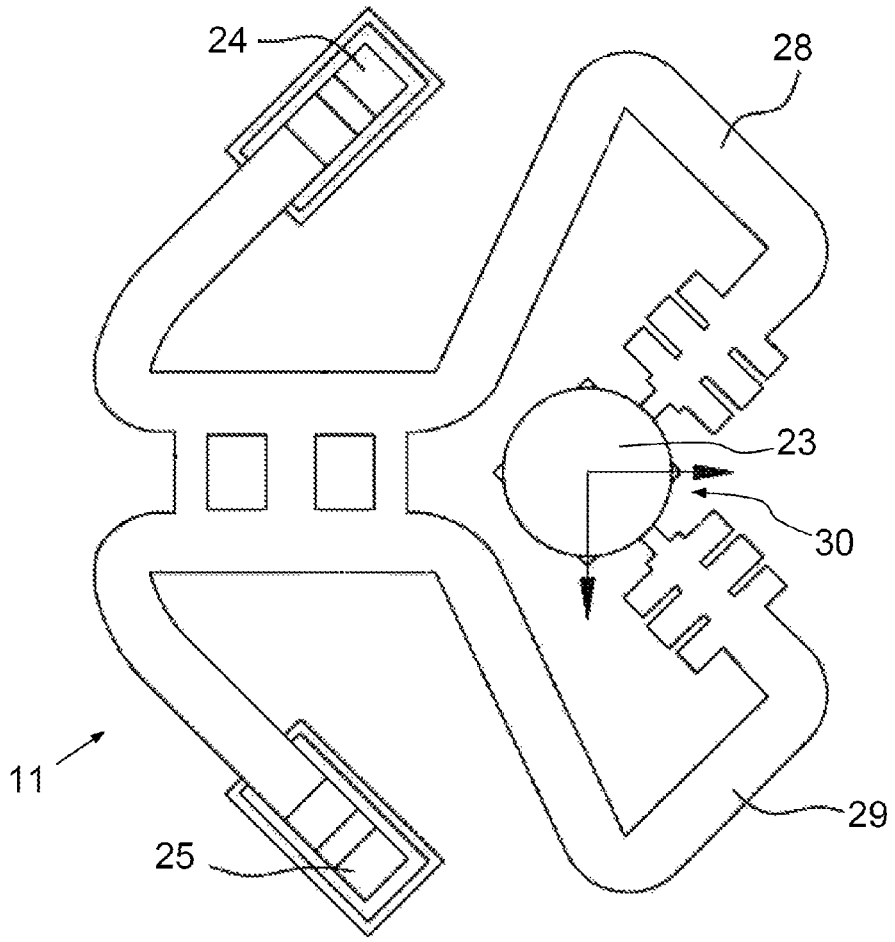
FIG. 4: a cross-sectional diagram of an example of a RF exciter suitable for use in the compact excitation module corresponding to FIGS. 1 and 2, according to the invention.

By way of non-limitative example, FIG. 4 shows an example of a compact planar RF exciter 11 with two channels, allowing mono-frequency and bipolarization operation and able to be used in the compact excitation module of the invention. In the example shown in FIG. 4, the RF exciter 11 comprises a planar radiofrequency RF chain made up of an orthomode transducer OMT with two arms 30 and of two RF recombination circuits 28, 29 linked to two input/output ports 24, 25 by means of a coupler. The OMT comprises a main waveguide 23 with a circular cross section having a longitudinal axis positioned so as to be parallel to the axis 5 and comprises two transverse arms located in a plane perpendicular to the axis 5 and respectively coupled to the main waveguide by two axial coupling slots. The two axial coupling slots pass through the wall of the axial waveguide and are angularly spaced apart by an angle equal to 90°. The two transverse arms of the OMT are respectively linked to two RF recombination circuits 28, 29 of the RF exciter 11 by means of filters. The two RF recombination circuits 28, 29 allow for the production of two waves with right and left circular polarization within the main cylindrical waveguide 23 of the OMT. The radiofrequency components possess a planar structure perpendicular to the axis 5 and are dedicated to the processing of radiofrequency RF signals corresponding to one and the same frequency band. The invention is of course not limited to this type of RF exciter. Any other single-channel or multi-channel exciter may equally be used. The number of input/output ports of the exciter is directly related to the number of channels of the RF exciter.

Figure 5A:
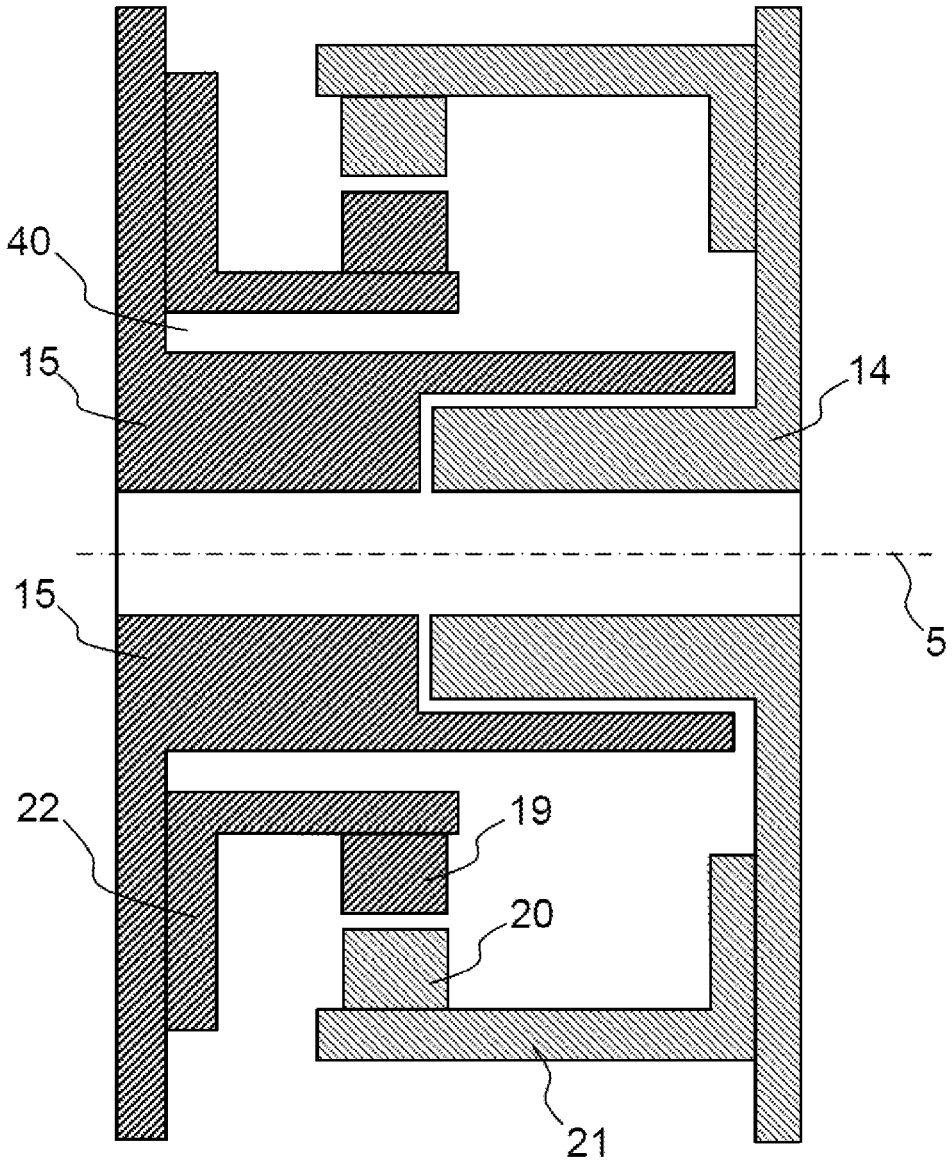
FIGS. 5*a* and 5*b*: two axial sectional diagrams of two examples of arrangements of a rotary joint in an axial orifice of a rotary actuator, according to the invention.
Figure 5B:
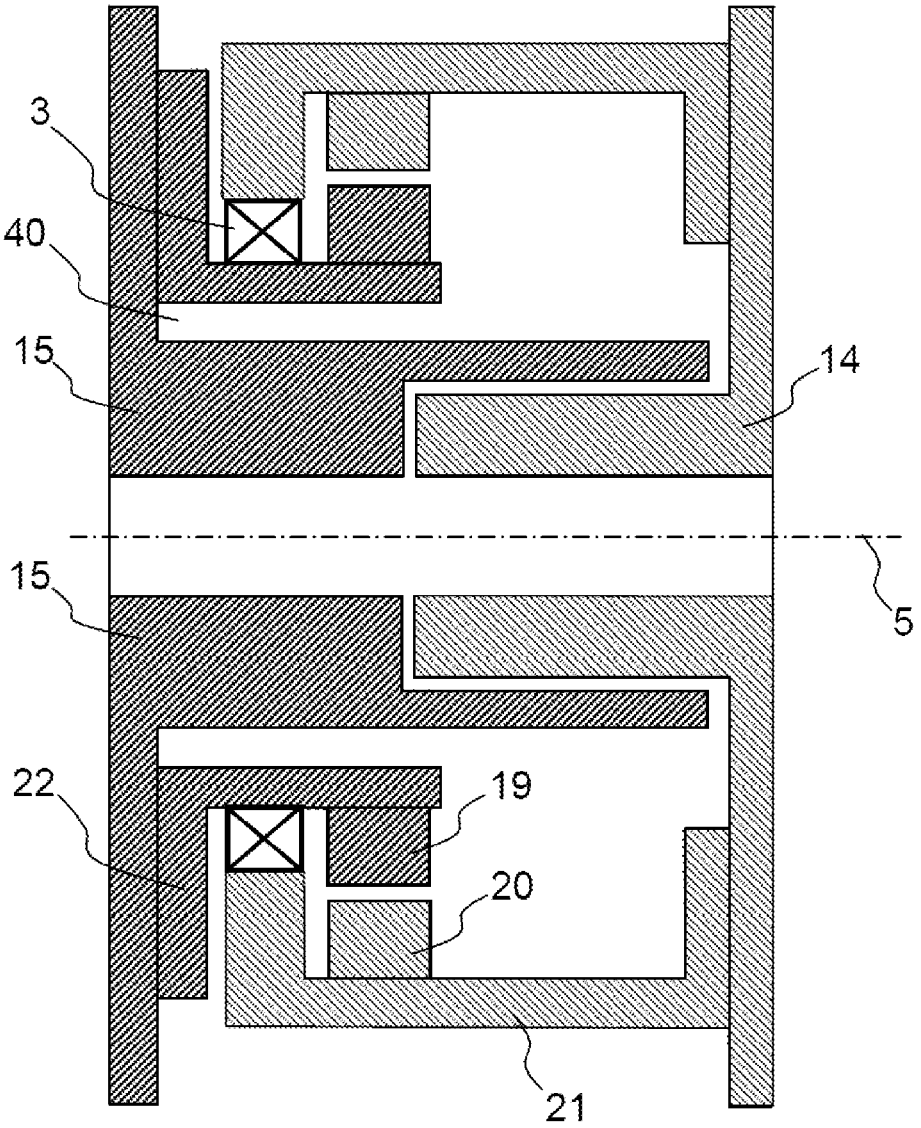

As illustrated in FIG. 2, the two RF exciters 11, 12 are mounted one on each side of the rotary joint 13, the main waveguides of the two RF exciters 11, 12 being coupled together by means of the axial waveguide 17 of the rotary joint 13. The main waveguide of the first compact exciter 11 is fixed to the stator part of the rotary joint 13 and in the extension of the axial waveguide 17 of the rotary joint, the main waveguide of the second compact exciter 12 is fixed to the rotor part of the rotary joint 13 and in the extension of the axial waveguide 17 of the rotary joint. The main waveguides of the two compact exciters 11, 12 and the axial waveguide 17 of the rotary joint 13 are therefore aligned along one and the same common longitudinal axis, parallel to the axis 5, and form a common cylindrical waveguide ensuring the radiofrequency link, i.e. the propagation of electromagnetic waves between the input port or ports 24, 25 of the first exciter 11 and the corresponding output port or ports 26, 27 of the second exciter 12. The compact excitation module furthermore comprises a rotary actuator 18 comprising a transverse cylindrical axial opening 40 oriented along the longitudinal axis 5, in which the rotary joint 13 is housed, as shown in FIGS. 5*a* and 5*b*. The rotary joint and the rotary actuator are therefore coaxial. The rotary actuator 18 comprises a rotor 19 coupled to the rotor 15 of the rotary joint 13 and a stator 20 coupled to the stator 14 of the rotary joint 13. As shown in the example in FIG. 5*b*, the stator can be mounted on a first support piece 21 and the rotor 15 can be mounted on a second support piece 22. In this case, the second support piece 22 may comprise an end mounted on the first support piece 21 by means of an interface piece, such as a ball bearing 3 for example. In operation, the rotary actuator 18 causes the rotor of the rotary joint 13 to rotate around the longitudinal axis 5, which in turn causes the rotation of the second exciter 12 joined to the rotor of the rotary joint. The first exciter 11 joined to the stator of the rotary joint 13 remains stationary. The radiofrequency link between the two exciters 11, 12 is ensured by the longitudinal waveguide 17 of axis 5 common to both compact exciters 11, 12 and to the rotary joint 13.

The compact excitation module 10 therefore allows, within a reduced volume, mechanical motorization and the radiofrequency link to be ensured respectively between both fixed and rotating parts of an antenna. It thus allows the orientation of an antenna element to be ensured, for example a radiating element, by rotating the second exciter 12, joined to rotor 15 of the rotary joint 13, around the axis 5. To this end, the accessways of the radiating element of the antenna must respectively be connected to the output accessways of the second exciter 12 joined to the rotor 15 of the rotary joint.

It is possible to combine two rotational movements along two different axes, for example orthogonal to each other, and to obtain, for example, a rotation of an antenna pointing axis in terms of azimuth and elevation, for example by combining two identical compact excitation modules 10, 50 coupled in series. The series coupling of the two compact excitation modules 10, 50 can, for example, be achieved by means of coaxial cables or waveguide bends as shown in FIGS. 6, 7*a*, 7*b*.

Figure 6:
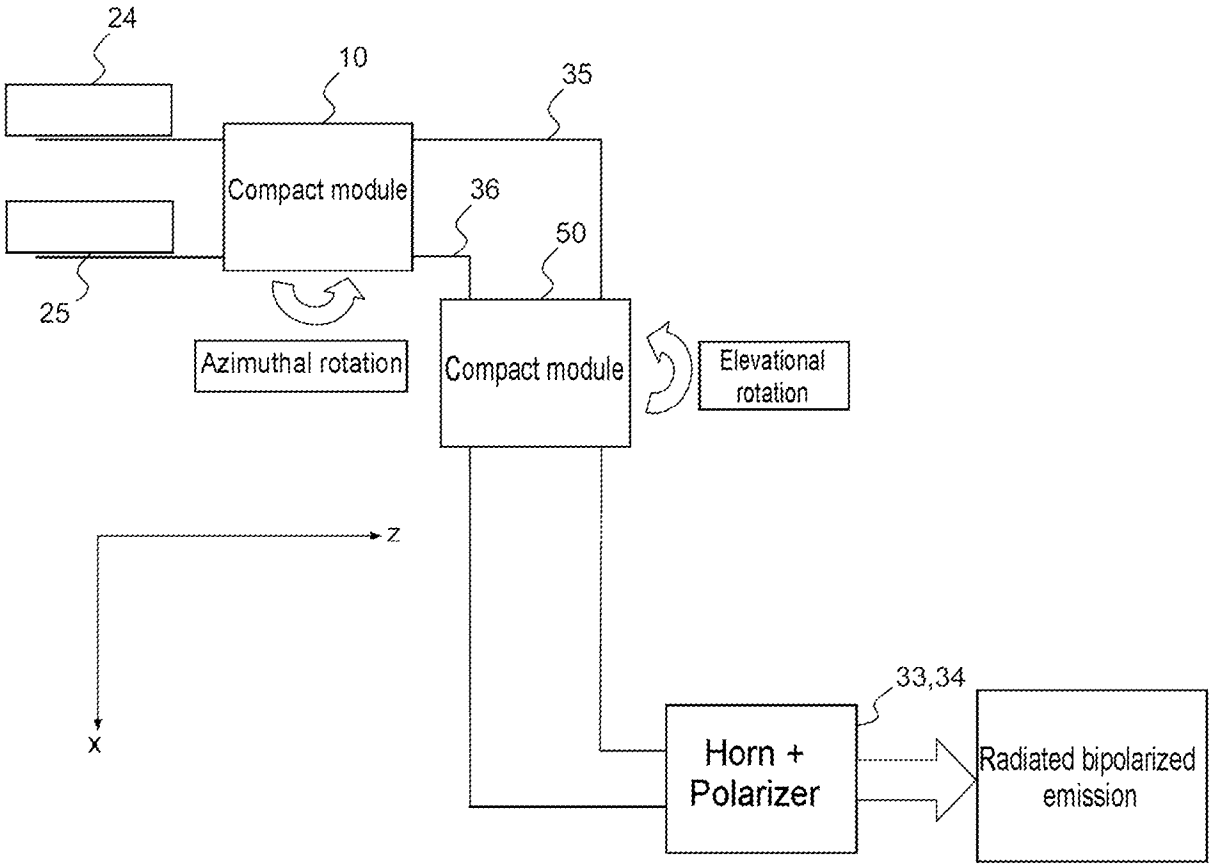
FIG. 6: a block diagram of a first example of highly compact biaxial mobile antenna architecture, comprising an assembly of two compact excitation modules coupled together and a radiating horn coupled to this assembly, according to the invention.
Figure 7A:
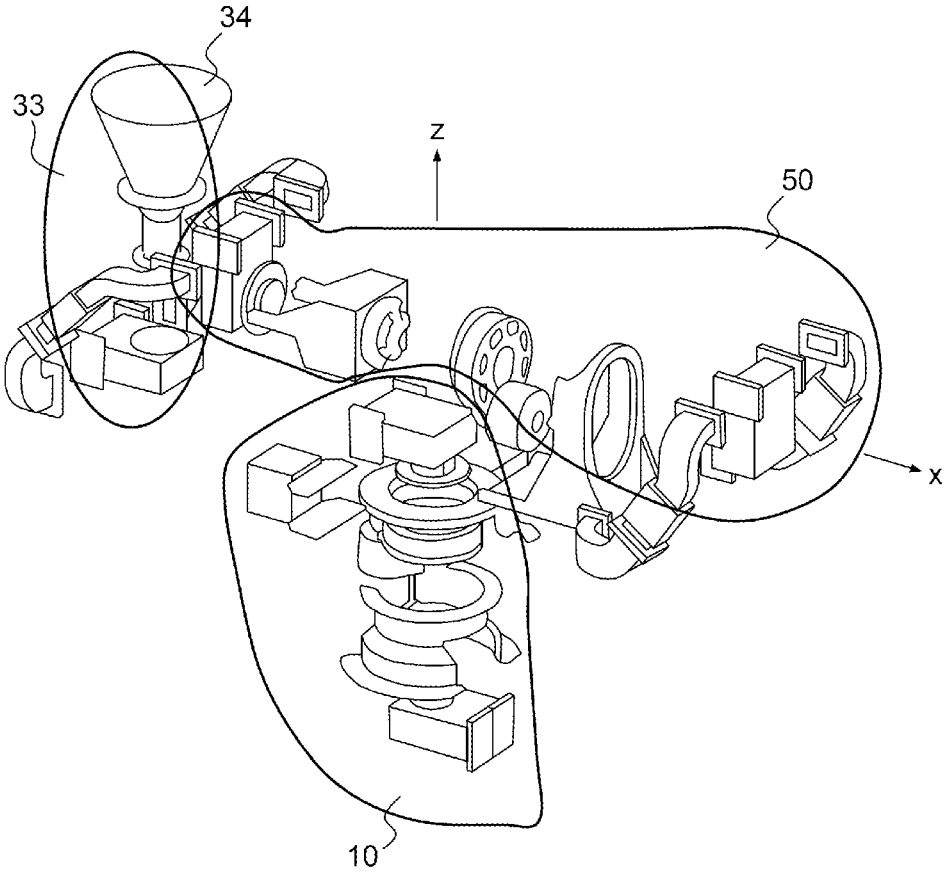
FIGS. 7*a* and 7*b*: a compact view and an exploded view of the antenna corresponding to FIG. 6, according to the invention.
Figure 7B:
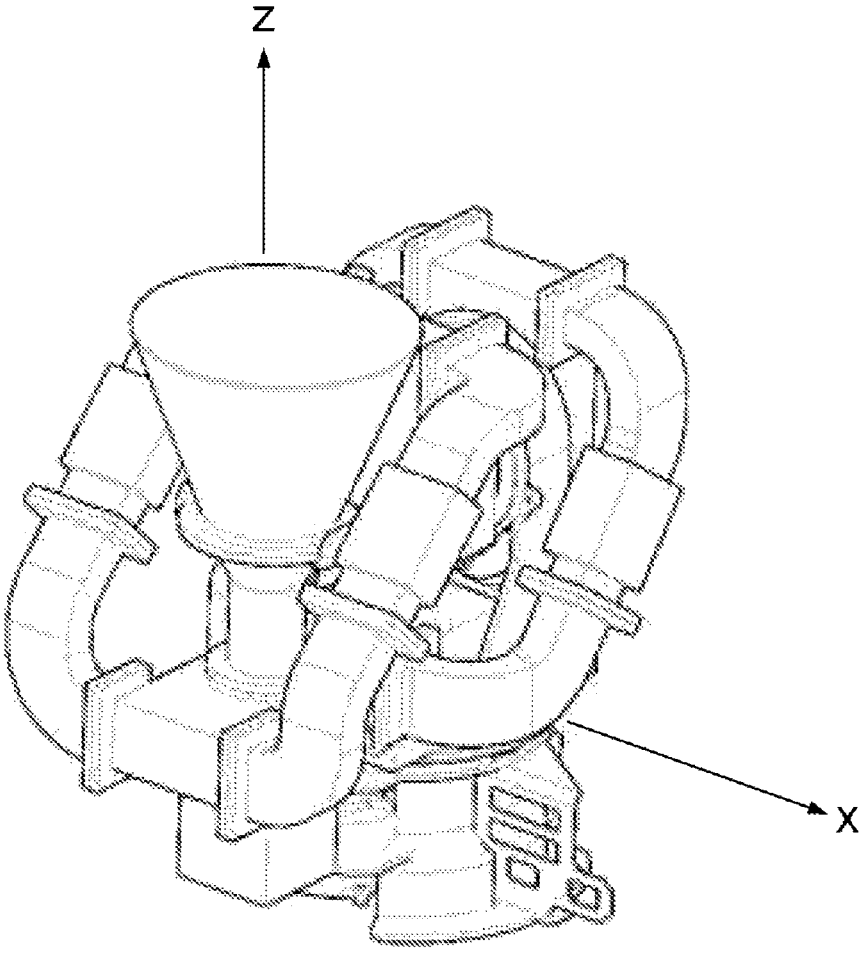

FIG. 6 shows a block diagram of a first example of highly compact biaxial mobile antenna architecture, comprising an assembly of two compact excitation modules 10, 50 coupled together and a radiating horn 34 associated with a polarizer 33 coupled to this assembly, according to the invention. A compact view and an exploded view of the corresponding antenna are shown in FIGS. 7*a* and 7*b*. The antenna comprises a first compact module 10 comprising a longitudinal axis oriented along a first azimuthal axis of rotation Z and a second compact module 50 having a longitudinal axis oriented along a second elevational axis of rotation X perpendicular to the first axis Z. The two compact modules 10, 50 are linked together so as to be perpendicular to one another, for example by waveguide bends or coaxial cables 35, 36 connected between two outputs of the first compact module 10 and two inputs of the second compact module 50. At the output of the assembly of the two compact modules, the second compact module 50 is linked to the input of a polarizer 33, to the output of which the radiating horn 34 is connected. Each compact module 10, 50 comprises two exciters 11, 12 coupled together by a rotary joint 13 housed in an axial opening of a respective rotary actuator 18, as described in conjunction with FIGS. 1 and 2. The first compact module 10 comprises a first rotary actuator which causes the rotor of a first rotary joint, along with the exciter joined to this rotor, to rotate around axis Z. The second compact module 50 comprises a second rotary actuator which causes the rotor of a second rotary joint and the exciter joined to it to rotate around axis X. The radiating horn 34 associated with the polarizer 33 coupled to the rotary part of the second compact module 50 is therefore rotated around the axis of elevation X by means of the rotor of the second rotary joint and around the azimuthal axis Z by means of the rotor of the first rotary joint, the azimuthal angle of rotation typically being between −180° and 180°, the elevational angle of rotation typically being between −70° and +70°. These two rotations combined allow the orientation of the radiating horn 34 of the antenna with respect to two orthogonal axes Z (azimuthal) and X (elevational) to be ensured, along with the pointing of the radiofrequency beam radiated by the antenna in a chosen direction, in a cone with a half-angle at the apex of the order of 70° to 80°.

Figure 8:
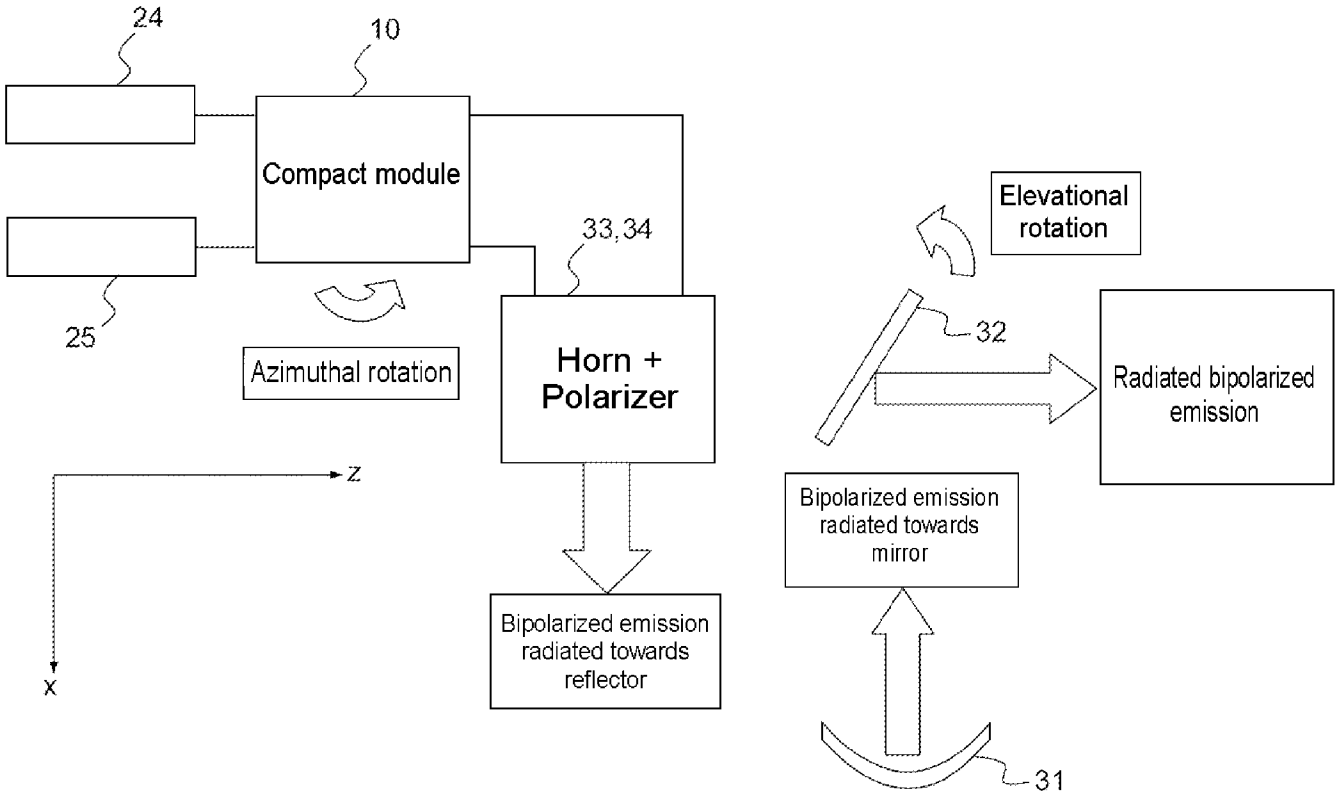
FIG. 8: a block diagram of a second example of highly compact biaxial mobile antenna architecture, comprising a compact excitation module coupled to a radiating horn, a parabolic reflector and an elevationally mobile reflector mirror, according to the invention.
Figure 9A:
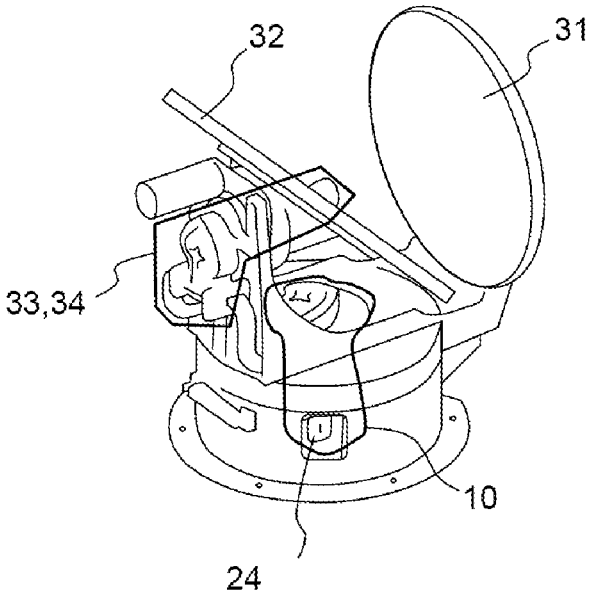
FIGS. 9*a* and 9*b*: a perspective view and a profile view of the antenna corresponding to FIG. 8, according to the invention.
Figure 9B:
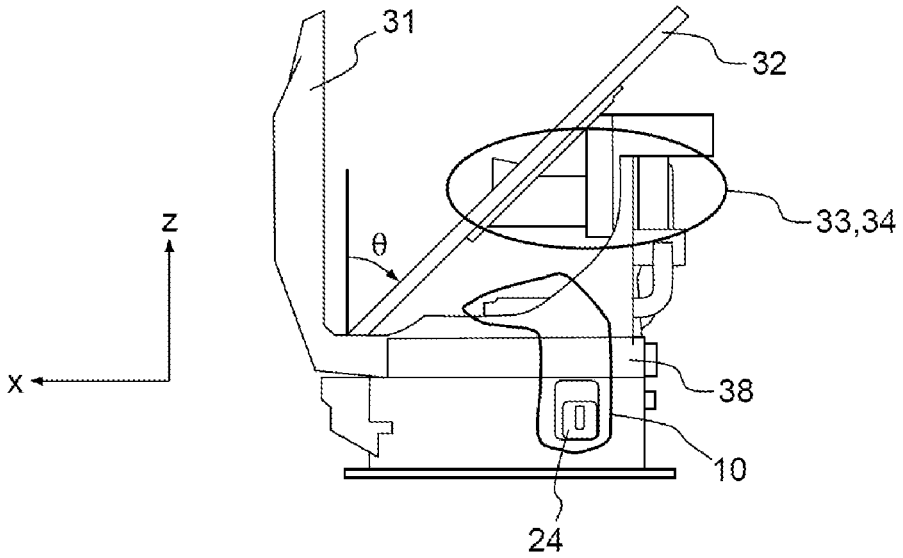

Alternatively, according to another embodiment of the invention, it is possible to combine two rotational movements in relation to two different axes, for example orthogonal to each other, and to obtain, for example, a rotation of an antenna pointing axis in terms of azimuth and elevation by combining a compact excitation module with an inclined plane mirror as shown in FIGS. 8, 9*a*, 9*b*.

FIG. 8 shows a block diagram of a second example of highly compact biaxial mobile antenna architecture, comprising a compact excitation module 10 coupled, via a radiofrequency link, to a radiating horn 34 associated with a polarizer 33, a reflector 31 and a plane mirror 32 inclined with respect to an axis of elevation X, according to the invention. The reflector 31 can be a parabolic or a shaped reflector. A perspective view and a profile view of the corresponding antenna are shown in FIGS. 9*a* and 9*b*. The reflector 31 and the plane mirror 32 are mounted on a turntable 38 of the antenna rotating around an azimuthal axis Z. Alternatively, the reflector and the mirror can be mechanically linked together by means of struts. This antenna architecture only comprises a single compact excitation module 10 comprising a longitudinal axis oriented along the azimuthal axis Z. The compact excitation module 10, housed inside the turntable 38 and not visible in FIGS. 9*a* and 9*b*, comprises two exciters coupled together by a rotary joint housed in an axial opening of a respective rotary actuator, as described in conjunction with FIGS. 1 and 2. The rotary actuator causes the turntable 38 of the antenna and the rotor of the rotary joint, along with the exciter joined to this rotor, to rotate around the azimuthal axis Z. The radiating horn associated with the polarizer is coupled to the exciter joined to the rotor of the rotary joint, which causes it to rotate around the azimuthal axis Z. The radiating horn 34 is positioned in front of the reflector 31, which ensures the reflection of the radiofrequency wave radiated by the horn 34 in the direction of the plane mirror 32 placed around the radiating horn 34 and oriented towards a direction of elevation forming an adjustable angle of elevation. The plane mirror 32 reflects the radiofrequency wave emitted by the assembly of radiating horn 34 and reflector 31 in the desired direction. The azimuthal mechanical mispointing of the beam emitted by the antenna is achieved by the combined rotation of the turntable 38 of the antenna and of the rotor of the rotary joint, and elevational mispointing is achieved by the modification of the angle of inclination of the plane mirror 32 with respect to the axis of elevation. This highly compact antenna architecture allows emission of a bipolarized radiofrequency wave in any chosen direction, within a wide angular scanning field corresponding to an azimuthal angle of rotation typically between −180° and 180° and an elevational angle of rotation θ typically between −70° and +70°.

Although the invention has been described in conjunction with specific embodiments, it is very clear that it is in no way limited thereto and that it includes all technical equivalents of the described means and combinations thereof should they lie within the scope of the invention. Thus, the invention is not limited to a specific type of RF exciter, but can be applied to any type of RF exciter, of TM01 or TE01 mode, equipped with a polarizer and/or an OMT, comprising one or multiple RF channels. Similarly, the number of inputs/outputs of each exciter is not limited to one or two, but may be greater than two.

The invention claimed is:

1. A compact excitation module comprising:

two radiofrequency exciters;

a rotary joint coupled to the radiofrequency exciters along a longitudinal axis, the rotary joint comprising a fixed part and a rotating part configured to rotate around the longitudinal axis, the radiofrequency exciters being mounted respectively on the fixed part and the rotating part and axially coupled together by the rotary joint; and a rotary actuator having an axial transverse opening oriented along the longitudinal axis, the rotary joint being housed in the axial transverse opening of the rotary actuator.

2. The compact excitation module according to claim 1, wherein the fixed part and the rotating part are fitted together without contact and parallel to the longitudinal axis, each of the fixed part and the rotating part comprising a transverse cylindrical axial opening forming an axial cylindrical waveguide.

3. The compact excitation module according to claim 2, wherein the fixed part and the rotating part are separated by an intermediate space, and at least one of the fixed part and the rotating part comprises a wall equipped with corrugations positioned in the intermediate space.

4. The compact excitation module according to claim 2, wherein the fixed part and the rotating part are separated by an intermediate space, and at least one of the fixed part and the rotating part comprises a wall equipped with at least one cavity in the intermediate space.

5. The compact excitation module according to claim 1, wherein each of the radiofrequency exciters comprises a main waveguide mounted along the longitudinal axis and coupled to an axial cylindrical waveguide of the rotary joint.

6. The compact excitation module according to claim 5, wherein each of the radiofrequency exciters comprises an orthomode transducer coupled to the main waveguide of the radiofrequency exciters.

7. The compact excitation module according to claim 5, wherein each of the radiofrequency exciters comprises a polarizer coupled to the main waveguide of the radiofrequency exciters.

8. A compact biaxial antenna comprising:

two compact excitation modules according to claim 1; and a radiating horn associated with a polarizer, wherein the longitudinal axes of the two compact excitation modules are oriented perpendicular to one another, and one of the two compact excitation module is linked to the polarizer.

9. A compact biaxial antenna comprising:

a compact excitation module according to claim 1;

a radiating horn associated with a polarizer;

a reflector; and a plane mirror inclined with respect to an axis of elevation and configured to reflect a radiofrequency wave emitted by the radiating horn, wherein the radiating horn is positioned in front of the reflector, and the compact excitation module comprises a longitudinal axis oriented along an azimuthal axis.

* * * * *